US008344843B2

(12) United States Patent
Larsen

(10) Patent No.: US 8,344,843 B2
(45) Date of Patent: Jan. 1, 2013

(54) FLUX TRANSFER DEVICE

(75) Inventor: John T. Larsen, Blue Springs, MO (US)

(73) Assignee: Solid State Magnetics Corporation, Blue Springs, MO (US)

( * ) Notice: Subject to any disclaimer, the term of this patent is extended or adjusted under 35 U.S.C. 154(b) by 0 days.

(21) Appl. No.: 13/223,894

(22) Filed: Sep. 1, 2011

(65) Prior Publication Data

US 2012/0062352 A1 Mar. 15, 2012

Related U.S. Application Data

(60) Provisional application No. 61/379,988, filed on Sep. 3, 2010.

(51) Int. Cl.
*H01F 17/04* (2006.01)
*H01F 27/28* (2006.01)

(52) U.S. Cl. ..... 336/221; 336/222; 336/224; 336/225; 336/232

(58) Field of Classification Search ..... 336/199, 336/205, 207, 208, 221, 222, 224, 225, 232
See application file for complete search history.

(56) References Cited

U.S. PATENT DOCUMENTS 5,254,925 A 10/1993 Flynn ..... 318/696
5,412,366 A * 5/1995 Ohji et al. ..... 336/120
5,455,474 A 10/1995 Flynn ..... 310/181
5,463,263 A 10/1995 Flynn ..... 310/181
6,246,561 B1 6/2001 Flynn ..... 156/154
6,342,746 B1 1/2002 Flynn ..... 464/172
6,362,718 B1 3/2002 Patrick et al. ..... 436/518
6,388,548 B1 * 5/2002 Saito et al. ..... 336/90
6,443,020 B1 * 9/2002 Lin et al. ..... 73/862.334
7,163,602 B2 * 1/2007 Ogle ..... 156/345.48
7,663,462 B2 * 2/2010 Makuth et al. ..... 336/130
7,898,135 B2 3/2011 Flynn ..... 514/622

* cited by examiner

*Primary Examiner* — Mohamad Musleh
*Assistant Examiner* — Joselito Baisa
(74) *Attorney, Agent, or Firm* — Hovey Williams LLP

(57) ABSTRACT

A flux transfer device includes a first conductive element for generating magnetic flux when energized by an electric current and a second conductive element being concentric with the first conductive element, wherein the second conductive element generates an electric voltage/current in response to changes in the magnetic flux. A first magnetic element is concentric with the first conductive element, such that the magnetic flux generated by the first conductive element displaces at least a portion of the magnetic flux from the first magnetic element, thereby inducing an electric voltage/current in the second conductive element. A third conductive element and a second magnetic element may be positioned concentrically with the first conductive element such that the magnetic flux generated by the first conductive element displaces at least a portion of magnetic flux from the second magnetic element, thereby inducing an electric voltage/current in the third conductive element.

20 Claims, 8 Drawing Sheets

FLUX TRANSFER DEVICE

RELATED APPLICATIONS

This non-provisional patent application claims priority benefit with regard to all common subject matter of earlier-filed U.S. provisional patent application titled CONCENTRIC PARALLEL PATH MAGNETIC FLUX TRANSFER DEVICE, filed Sep. 3, 2010, and assigned application No. 61/379,988. The earlier-filed application is hereby incorporated by reference into the present application.

BACKGROUND

1. Field

Embodiments of the present invention relate to flux transfer devices. More particularly, embodiments of the present invention relate to devices that use fluctuating magnetic fields to shift the magnetic flux of one or more magnets, thereby inducing an electric voltage in one or more conductive elements positioned proximate the magnets.

2. Related Art

Transformers and similar devices are known in the art that use properties of magnetism to transfer electrical power between conductive coils or windings through a principle known in the art as magnetic induction, wherein a first coil is energized to create a fluctuating magnetic field which induces a voltage in a second coil physically and electrically separate from the first coil.

By way of example, some electric motor designs known in the art use both permanent and electromagnets, such as those disclosed in U.S. Pat. Nos. 6,342,746, 5,463,263, 5,455,474 and 5,254,925. The concept of a motionless electromagnetic generator, or "MEG," is also known in the art. An MEG, such as the MEG disclosed in U.S. Pat. No. 6,362,718, may use a combination of permanent magnets and multiple primary coils configured and operated as electromagnets to generate electric power on multiple secondary coils. An MEG configured in this manner may use electromagnetic flux generated by the permanent magnets, by the electromagnets, or both to induce a voltage in the secondary coils. Unfortunately, devices such as the aforementioned MEG and electric motors suffer from limitations. For example, operational inefficiencies due to electrical and magnetic losses may render such devices impractical or undesirable.

Accordingly, there is a need for a device which overcomes the limitations described above.

SUMMARY

A flux transfer device in accordance with a first embodiment of the invention comprises a first conductive element presenting a loop configuration for generating magnetic flux when energized by an electric current, and a second conductive element presenting a loop configuration and being concentric with the first conductive element, wherein the second conductive element generates an electric voltage in response to changes in the magnetic flux. A first magnetic element is concentric with the first conductive element, such that the magnetic flux generated by the first conductive element displaces at least a portion of the magnetic flux from the first magnetic element, thereby inducing an electric voltage in the second conductive element.

A flux transfer device in accordance with a second embodiment of the invention comprises a first metal coil for generating magnetic flux when energized by an electric current and a second metal coil positioned radially inward of and concentric with the first metal coil, wherein the second metal coil generates an electric voltage in response to changes in magnetic flux. A first magnetic element is positioned radially inward of and concentric with the second metal coil, and a third metal coil is positioned radially outward of and concentric with the first metal coil. The third metal coil generates an electric voltage in response to changes in magnetic flux.

A second magnetic element is positioned radially outward of and concentric with the third metal coil, such that the magnetic flux generated by the first metal coil causes magnetic flux generated by the first and second magnetic elements to shift, thereby altering an amount of magnetic flux passing through the second and third metal coils.

A flux transfer device in accordance with a third embodiment of the invention comprises a first magnetic element presenting a loop configuration, a first conductive element presenting a loop configuration and positioned concentrically outwards of the first magnetic element, and a first permeance element presenting a loop configuration and positioned concentrically outwards of the first conductive element. The first permeance element channels magnetic flux from the first magnetic element. A second conductive element presents a loop configuration and is positioned concentrically outwards of the first permeance element, a third conductive element presents a loop configuration and is positioned concentrically outwards of the second conductive element, and a fourth conductive element presents a loop configuration and is positioned concentrically outwards of the third conductive element.

A second permeance element presents a loop configuration and is positioned concentrically outwards of the fourth conductive element and a fifth conductive element presents a loop configuration and is positioned concentrically outwards of the second permeance element. A second magnetic element presents a loop configuration and is placed concentrically outwards of the fifth conductive element. Magnetic flux generated by the second magnetic element is channeled by the second permeance element.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the preferred embodiments and the accompanying drawing figures.

Figure 1:
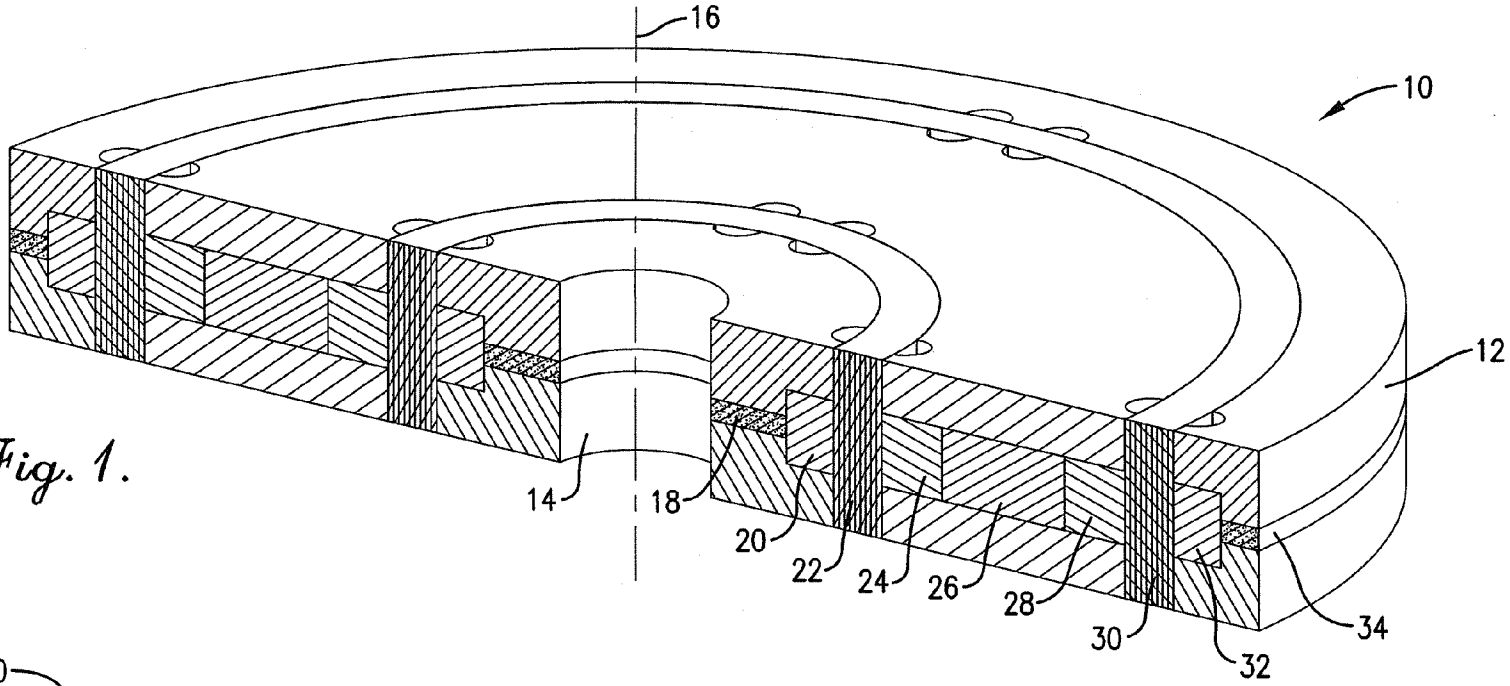
FIG. 1 is a perspective vertical cross-sectional view of a flux transfer device constructed according to a first embodiment of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention may be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 2:
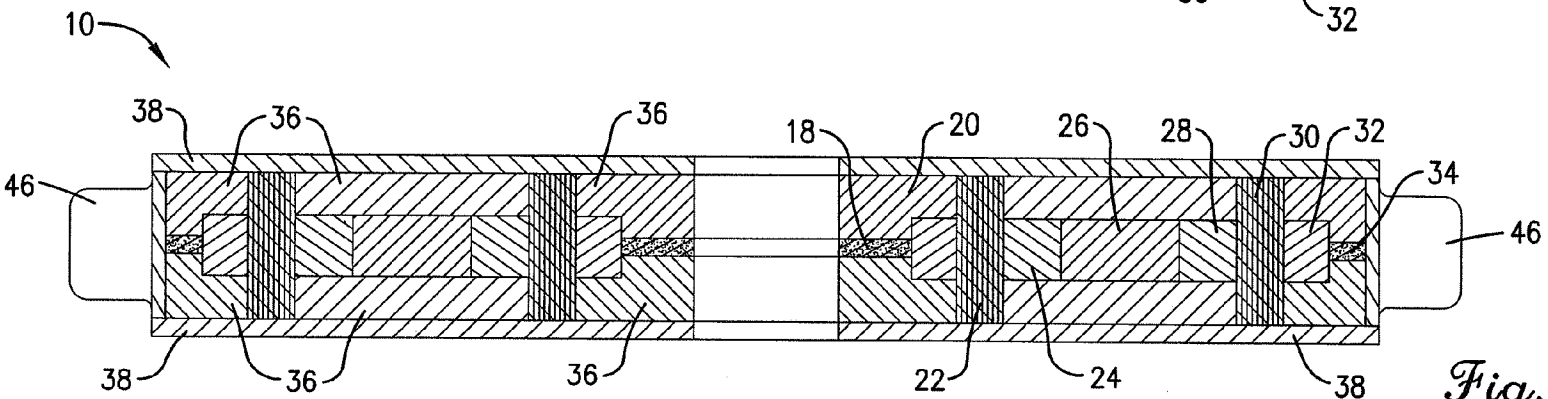
FIG. 2 is a vertical cross-sectional view of the flux transfer device of FIG. 1.
Figure 3:
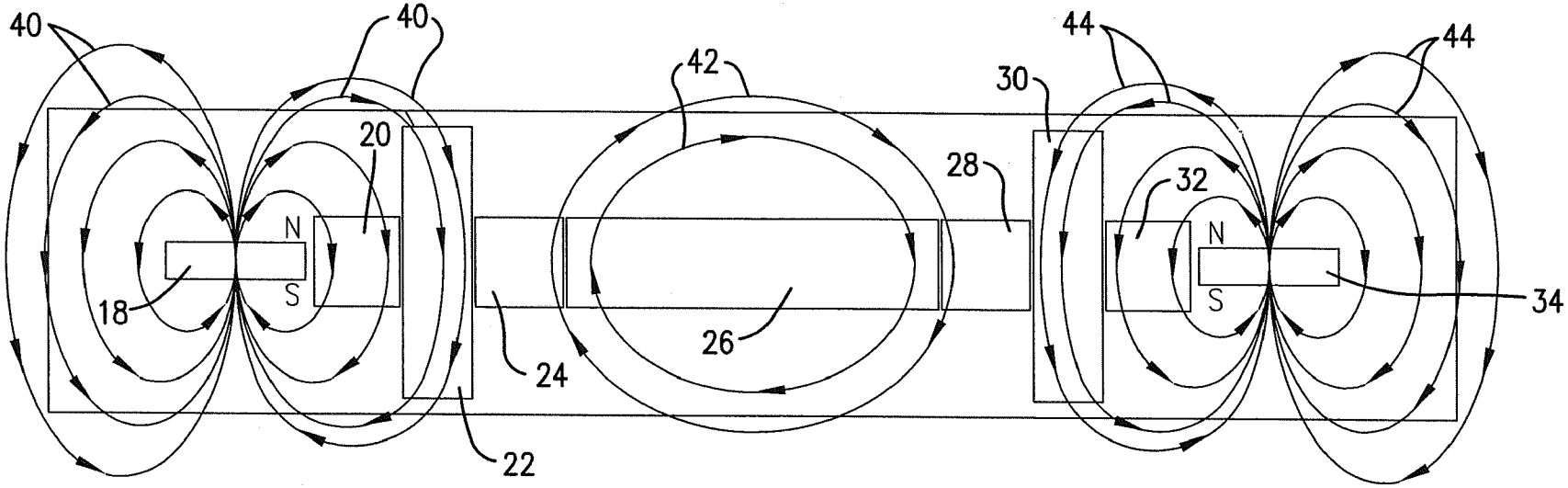
FIG. 3 is a schematic diagram of the flux transfer device of FIG. 1, demonstrating magnetic flux lines associated with various magnetized elements of the device.

Turning now to the drawings, and particularly FIGS. 1-3, a flux transfer device 10 in accordance with a first embodiment of the invention is illustrated. The device 10 generally presents a disc shape with an outer edge 12 and an inner edge 14 presenting circular configurations about an axis 16, the inner edge 14 defining a cylindrical aperture through a center of the device 10. The device 10 may comprise a plurality of generally ring-shaped elements in fixed positions progressively radially outward from the axis 16, each of the elements being in concentric relationship and substantially coplanar with the other elements, as explained below in greater detail. In operation, the device 10 may use a fluctuating electromagnetic field generated by a control element to shift magnetic flux from one or more magnetic elements to induce an electric voltage/current in one or more conductive elements.

Various elements of the device 10 will now be described in greater detail. The various elements of the device may be arranged in fixed positions progressively radially outward from the axis 16, and the elements may be concentric or substantially concentric wherein the axis 16 or a point on the axis 16 defines an approximate center of each element. An innermost element may be a first magnetic element 18, followed by a first conductive element 20, a first permeance element 22, a second conductive element 24, a control element 26, a third conductive element 28, a second permeance element 30, a fourth conductive element 32, and finally a second magnetic element 34. Various peripheral permeance elements 36 may be positioned around some or all of the first magnetic element 18, first conductive element 20, first permeance element 22, second conductive element 24, control element 26, third conductive element 28, second permeance element 30, fourth conductive element 32, and second magnetic element 34. Finally, a shell 38 may enclose, protect and shield the other elements of the device 10.

As used herein, the terms "loop" and "loop configuration" refer to a shape or configuration forming a closed or partially closed path such that variations in magnetic flux through an area defined by an inside of the path would result in an induced electric voltage/current in a conductor on the path. Thus, an element presenting a loop configuration may be circular, elliptical, rectangular, or other shape such as hexagonal or octagonal, or may present a more arbitrary shape. Furthermore, when reference is made herein to magnetic flux passing through a loop, it means that at least a portion of the flux intersects an area defined by an inside of the loop. When reference is made herein to magnetic flux passing through an element, it means that at least a portion of the flux intersects an area defined by an inside of a loop corresponding to at least a portion of the element.

In the illustrated embodiment, the first magnetic element 18 occupies an innermost position adjacent to or proximate the first conductive element 20. The first magnetic element 18 generates a magnetic flux 40, at least a portion of which passes through a loop defined by a portion of the first conductive element 20. The first magnetic element 18 is positioned such that north and south poles of the element lie generally on a line that is partially or substantially parallel with the axis 16, as illustrated in FIG. 3.

The first magnetic element 18 is preferably a permanent magnet, such as an N35 Neodymium magnet, but may alternatively be a permanent magnet of a different type or grade, such as an N28, N35 or N40 magnet, or may be an electromagnet. The magnetic element 18 presents a loop configuration and may include a substantially continuous, solid material, as illustrated, or alternatively may comprise a plurality of separate, discontinuous components arranged generally in a loop configuration. An inner diameter of the magnetic element 18 may be approximately two inches, an outer diameter may be approximately four inches, and the magnetic element may be approximately one-quarter of an inch in height.

The first conductive element 20 generally presents a loop configuration, is adjacent or proximate the first magnetic element 18 and the first permeance element 22, and is positioned radially outwardly of the first magnetic element 18. Variations in magnetic flux through the first conductive element 20 induce a voltage/current in the conductive element 20, which may be used to power an external load. Thus, the first conductive element 20 is at least partially electrically conductive and may comprise a single, solid, continuous conductive material or, alternatively, a winding of conductive wire or ribbon. By way of example, the first conductive element 20 may include a winding of copper wire, a winding of copper ribbon, or both. Particularly, the first conductive element 20 may comprise fifty-five turns of copper ribbon with an inner diameter of approximately four inches, an outer diameter of approximately five and one-half inches, and a height of approximately one and one-half inches.

Electrical leads (not shown) may be connected to the first conductive element 20 and to an external load in a conventional manner, thus enabling induced electrical voltage/current on the first conductive element 20 to power the external load. If the first conductive element 20 comprises a winding of copper wire or ribbon, for example, a first end of the copper wire or ribbon may be connected to a first electrical lead while a second end of the copper wire or ribbon may be connected to a second electrical lead.

The first permeance element 22 is adjacent or proximate the first conductive element 20 and the second conductive element 24, is positioned radially outwardly of the first conductive element 20, and is generally interposed between the first conductive element 20 and the second conductive element 24. The first permeance element 22 attracts and channels magnetic flux 40 generated by the first magnetic element 18, magnetic flux 42 generated by the control element 26, or both. Thus, the first permeance element 22 presents a magnetic permeability that is generally higher than that of the first 20 and second 24 conductive elements and other elements of the device 10 proximate the first permeance element 22. Magnetic flux 40 from the first magnetic element 18 that may otherwise pass near the first permeance element 22 instead pass through the permeance element 22 due to its magnetic properties.

The first permeance element 22 is preferably constructed at least in part from a material that presents a relatively high magnetic permeability, such as steel or ferrite. By way of example, the first permeance element 22 may include substantially solid and continuous steel or ferrite material, may include a plurality of separate or discontinuous components constructed of such material, or may include a winding of such material. Furthermore, the first permeance element 22 may be constructed only in part of a material presenting a high magnetic permeability, such as a winding of copper-clad steel wire or ribbon. In an exemplary embodiment, the first permeance element is constructed of a winding of fifty-five turns of copper-clad steel ribbon comprising thirty percent copper and seventy percent steel, with kapton or other material with similar properties interposed between the windings to electrically insulate each winding. The insulating material may be relatively thin, presenting a thickness of one one-thousandth of an inch or less. The permeance element 22 may be taller than the first 20 and second 24 conductive elements (as illustrated). More particularly, the first permeance element 22 may be approximately twice the height of the first 20 and second 24 conductive elements, and may be about three to four inches in height with an inner diameter of five and one-half inches and an outer diameter of about seven inches.

The second conductive element 24 generally presents a loop configuration, is adjacent or proximate the first permeance element 22 and the control element 26, and is positioned radially outwardly of the first permeance element 22. Variations in magnetic flux through the second conductive element 24 induce a voltage/current in the second conductive element 24, which may be used to power an external load. Thus, the second conductive element 24 is at least partially electrically conductive and may comprise a single, solid, continuous conductive material or, alternatively, a winding of conductive wire or ribbon. By way of example, the second conductive element 24 may include a winding of copper wire, a winding of copper ribbon, or both. Particularly, the second conductive element 24 may comprise fifty-five turns of copper ribbon with an inner diameter of approximately seven inches, an outer diameter of approximately eight and three-quarter inches, and a height of approximately one and one-half inches.

Electrical leads (not shown) may be connected to the second conductive element 24 and to an external load in a conventional manner, thus enabling induced electrical voltage/current on the second conductive element 24 to power the external load. If the second conductive element 24 comprises a winding of copper wire or ribbon, for example, a first end of the copper wire or ribbon may be connected to a first electrical lead while a second end of the copper wire or ribbon may be connected to a second electrical lead.

The control element 26 generally presents a loop configuration, is adjacent or proximate the second conductive element 24 and the third conductive element 28, is positioned radially outwardly of the second conductive element 24, and is generally interposed between the second 24 and third 28 conductive elements. The control element 26 is at least partially electrically conductive and may also have relatively high magnetic permeability. The control element 26 may comprise a single, solid, continuous conductive material or, alternatively, a winding of conductive wire or ribbon. By way of example, the control element 26 may include a winding of copper clad steel wire, copper clad steel ribbon, or both. Particularly, the control element 26 may comprise one hundred and thirty nine turns of copper-clad steel ribbon comprising forty percent copper and sixty percent steel, with kapton or other material with similar properties interposed between the windings to electrically insulate each winding. The insulating material may be relatively thin, presenting a thickness of one one-thousandth of an inch or less. The control element 26 may have an inner diameter of about eight and three-quarters inches, an outer diameter of about ten and three-quarters inches, and a height of about one and one-half inches.

The control element 26 is energized with an electric current to generate a fluctuating electromagnetic field 42 that interacts with magnetic fields 40,44 generated by the first 18 and second 34 magnetic elements to induce an electric voltage/current in one or more of the first 20, second 24, third 28 and fourth 32 conductive elements by varying a total amount of magnetic flux passing through one or more of those elements. Thus, electrical leads (not shown) may be connected to the control element 26 in a conventional manner to enable or facilitate access to the control element 26. By way of example, if the control element 26 includes a coil of wire or ribbon, a first end of the coil may be connected to a first lead and a second end of the coil may be connected to a second lead. Operation of the control element 26 is discussed in greater detail below.

The third conductive element 28 generally presents a loop configuration, is adjacent or proximate the control element 26 and the second permeance element 30, is positioned radially outwardly of the control element 26, and is generally interposed between the control element 26 and the second permeance element 30. The third conductive element 28 may present an inner diameter of about ten and three-quarters inches and an outer diameter of about twelve and one-half inches, but may otherwise be similar or identical to the second conductive element 24 in form and function.

The second permeance element 30 is adjacent or proximate the third 28 and fourth 32 conductive elements, is positioned radially outwardly of the third conductive element 28, and is generally interposed between the third 28 and fourth 32 conductive elements. The second permeance element 30 may present an inner diameter of about twelve and one-half inches and an outer diameter of about fourteen inches, but may otherwise be similar or identical to the first permeance element 22 in form and function.

The fourth conductive element 32 generally presents a loop configuration, is adjacent or proximate the second permeance element 30 and the second magnetic element 34, is positioned radially outwardly of the second permeance element 30, and is generally interposed between the second permeance element 30 and the second magnetic element 34. The fourth conductive element 32 may present an inner diameter of about fourteen inches and an outer diameter of about fifteen and one-half inches, but may otherwise be similar or identical to the first conductive element 20 in form and function.

The second magnetic element 34 generally occupies an outermost position, is adjacent or proximate the fourth conductive element 32, and is positioned radially outwardly of the fourth conductive element 32. The second magnetic element 34 generates a magnetic field 44, at least a portion of which passes through a loop defined by the third 28 and/or fourth 32 conductive elements. The second magnetic element 34 is positioned such that north and south poles of the element lie generally on a line that is partially or substantially parallel with the axis 16, as illustrated in FIG. 3. The second magnetic element 34 may have an inner diameter of about fifteen and one-half inches, an outer diameter of about sixteen and one-half inches, and a height of about one-quarter of an inch.

The peripheral permeance elements 36 may be positioned around some or all of the first magnetic element 18, first conductive element 20, first permeance element 22, second conductive element 24, control element 26, third conductive element 28, second permeance element 30, fourth conductive element 32, and second magnetic element 34. The peripheral permeance elements 36 enhance the performance of the device 10 by presenting relatively high magnetic permeability, diminishing unwanted "eddy" currents, or both. The elements 36 may additionally protect the other elements, provide structural support to the device 10, or both. By way of example, the peripheral permeance elements 36 may be partially or entirely constructed of transformer plates, such as M19 transformer plates, and positioned to fit snuggly against the other elements of the device 10 to prevent or minimize the existence of gaps between the permeance elements 36 and the other elements of the device 10. The outer shell 38 may further encase, shield and protect the device, may be constructed of aluminum, and may include one or more fins or heat sinks 46 to enhance heat dissipation. While the shell 38 is not essential to the operation of the device 10, it has been omitted from FIG. 1 for illustrative purposes only.

It will be appreciated that the particular physical makeup of each of the elements described above is not essential to operation of the device 10 or to the present invention in general, and that different physical characteristics, including size and shape, may be employed with equal effectiveness. Furthermore, while the device 10 has been described and illustrated such that little or no gap exists between the various elements, such is not required and spaces or gaps may be introduced between two or more of the various elements without comprising performance. It may be desirable or necessary to introduce spaces or gaps, for example, to accommodate variations in size of the various elements.

Figure 7:
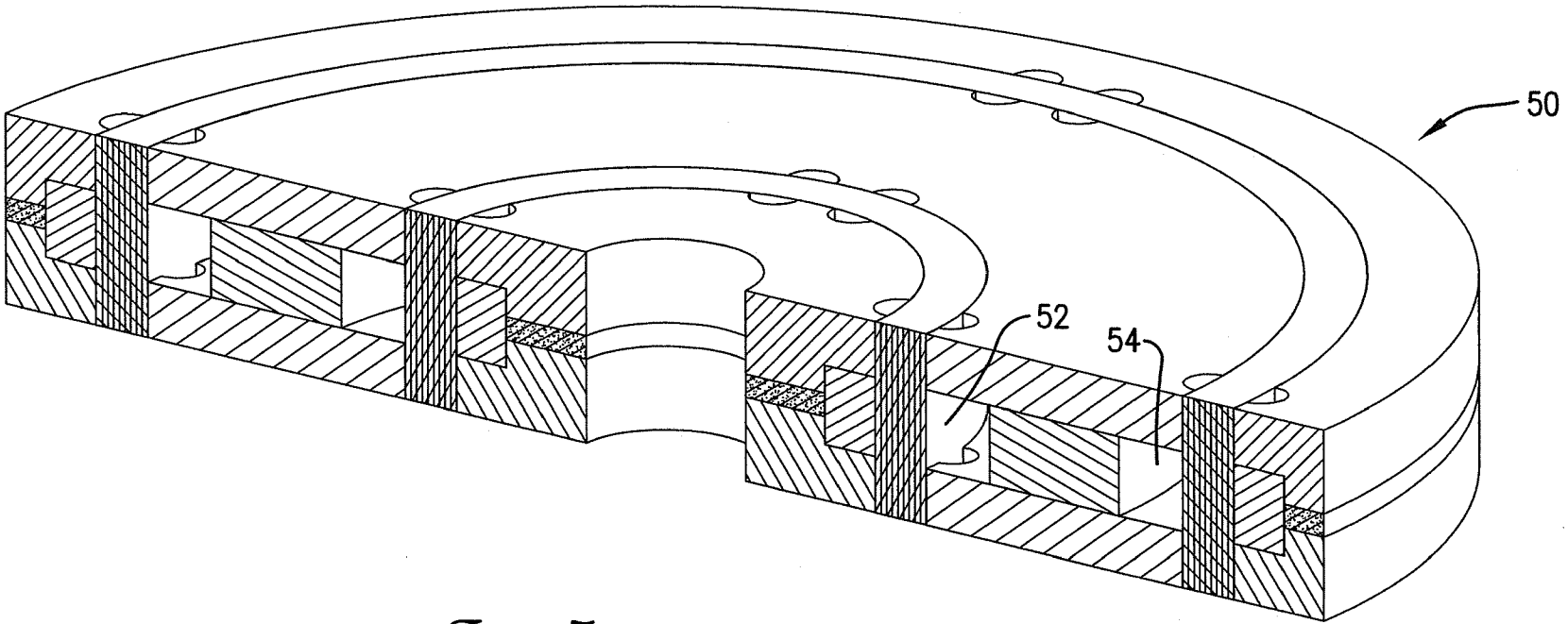
FIG. 7 is a perspective cross-sectional view of a flux transfer device constructed according to a third exemplary embodiment of the invention.

It will also be appreciated that not all of the elements described above are essential or even necessary to the present invention, and that one or several of the elements may be omitted without compromising principles of operation of the invention. By way of example, an exemplary device embodying principles of the present invention may include only the control element 26, one of the first 20 or second 24 conductive elements, and the first magnetic element 18. In a particular exemplary embodiment illustrated in FIG. 7, a device similar to the device 10 is shown, wherein with the second 24 and third 28 conductive elements are omitted and replaced with air gaps 52,54.

With particular reference to FIG. 3, the magnetic flux 40,44 generated by the first magnetic element 18, the control element 26, and the second magnetic element 34 are illustrated. The direction of the magnetic flux lines associated with the first 18 and second 34 magnetic elements is generally fixed, while the direction of the magnetic flux lines associated with the control element 26 depends on the direction of electrical current flowing through the control element 26.

In the area between the first magnetic element 18 and the control element 26, the flux lines 42 associated with the control element 26 generally flow in an opposite direction than the flux lines 40 associated with the first magnetic element 18, as indicated by the arrows. In the area between the second magnetic element 34 and the control element 26, the flux lines 42 associated with the control element 26 generally flow in the same direction as the flux lines 44 associated with the second magnetic element 34. In other words, magnetic flux 42 from control element 26 generally opposes, or interferes with, magnetic flux 40 from the first magnetic element 18 but complements magnetic flux 44 from the second magnetic element 34. Thus, a magnetic flux profile associated with the first conductive element 20, the first permeance element 22, and the second conductive element 24 will be different than a magnetic flux profile associated with the third conductive element 28, the second permeance element 30, and the fourth conductive element 32. For example, the magnetic flux 42 associated with the control element 26 may push the magnetic flux 40 associated with the first magnetic element 18 away from the control element 26 and into the first permeance element 22 or beyond the first permeance element 22 toward the first magnetic element 18, and may pull the magnetic flux 44 associated with the second magnetic element 34 toward the control element 26 and into the second permeance element 30 or beyond the second permeance element 30 toward the control element 26. If the electric current in the control element 26 is reversed, the direction of the magnetic flux 42 generate by the control element 26 is also reversed, reversing the effects on the magnetic flux from the first 18 and second 34 magnetic elements.

If an electric current in the control element 26 is varied over time, the magnetic field 42 associated with the control element 26 will also vary over time, causing interaction with the magnetic fields 40,44 from the first 18 and second 34 magnetic elements to change. As these interactions vary over time a total amount of flux passing through one or more of the first 20, second 24, third 28, and fourth 32 conductive elements also changes over time, thereby inducing electrical voltage/current in one or more of the conductive elements 20,24,28,32.

Figure 4:
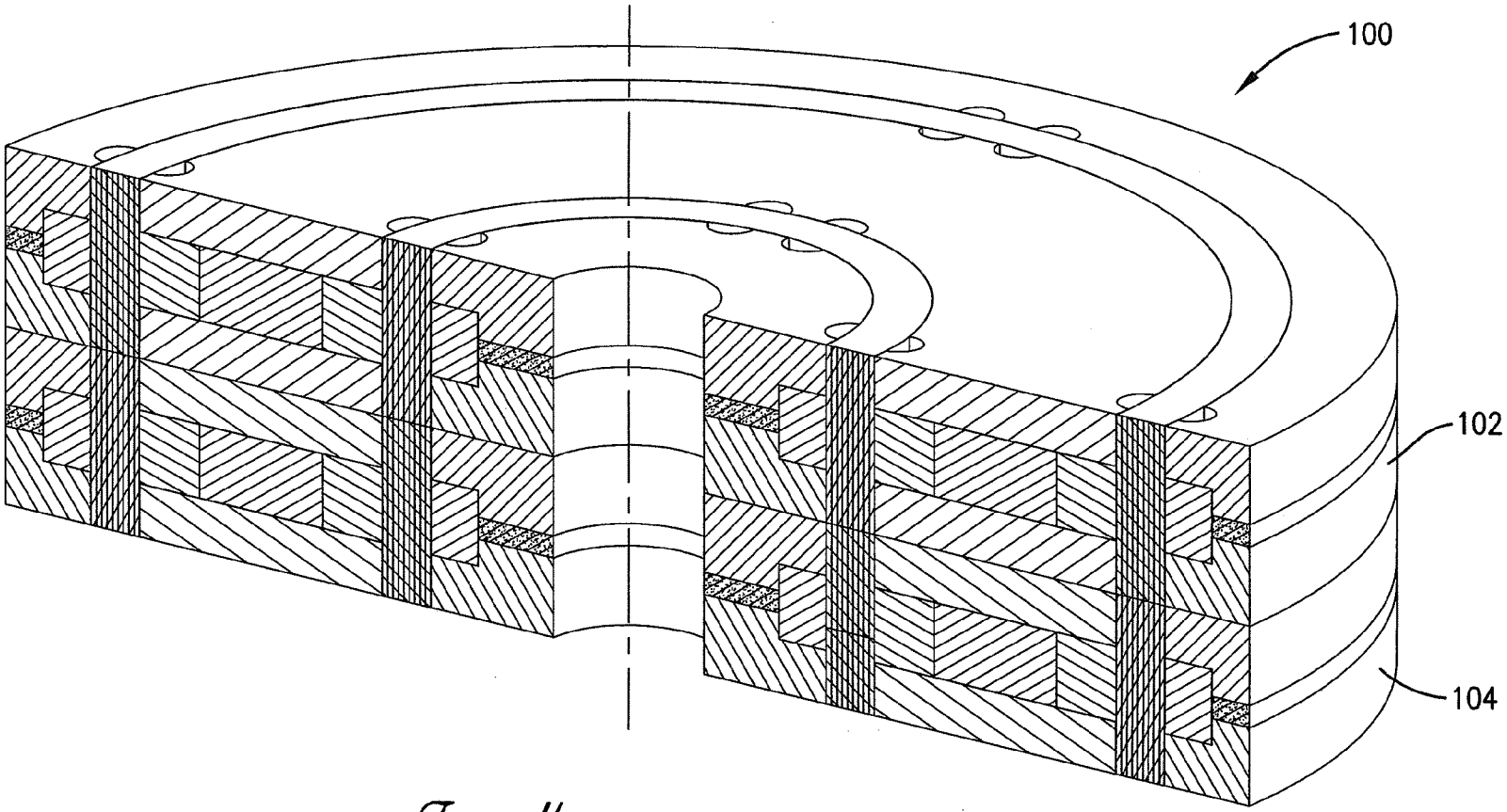
FIG. 4 is a perspective vertical cross-sectional view of a flux transfer assembly constructed according to a second exemplary embodiment of the invention, the assembly including a plurality of devices each constructed according to the embodiment of FIG. 1.
Figure 5:
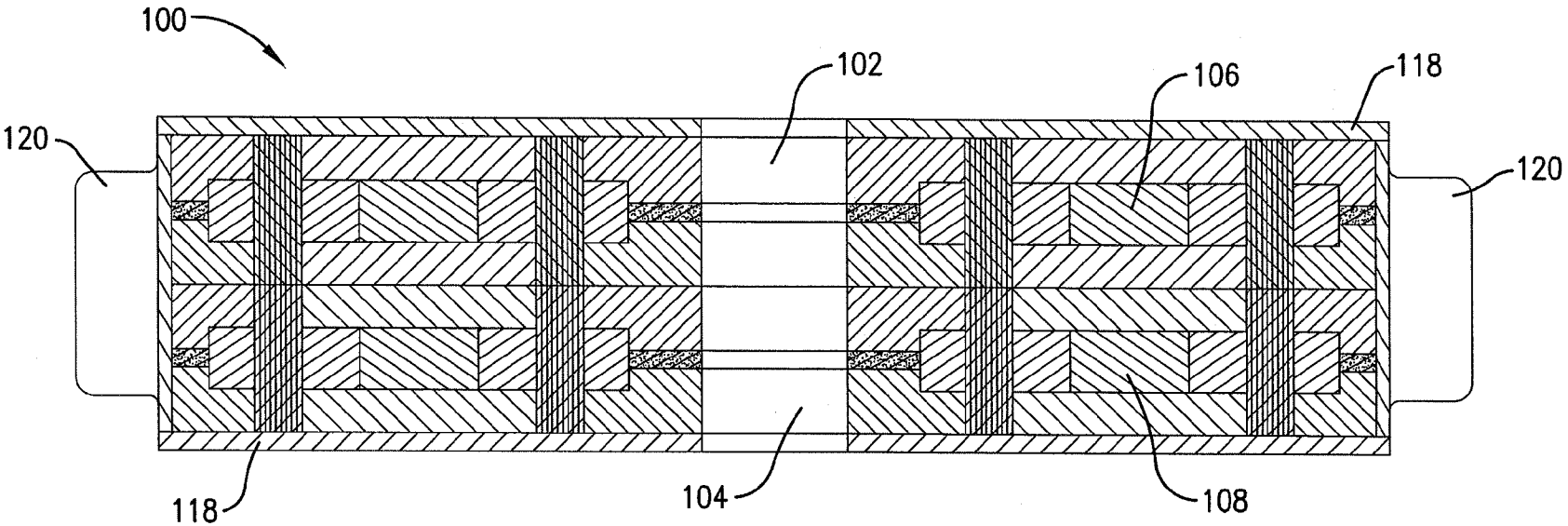
FIG. 5 is a front elevation cross-sectional view of the assembly of claim 4.
Figure 6:
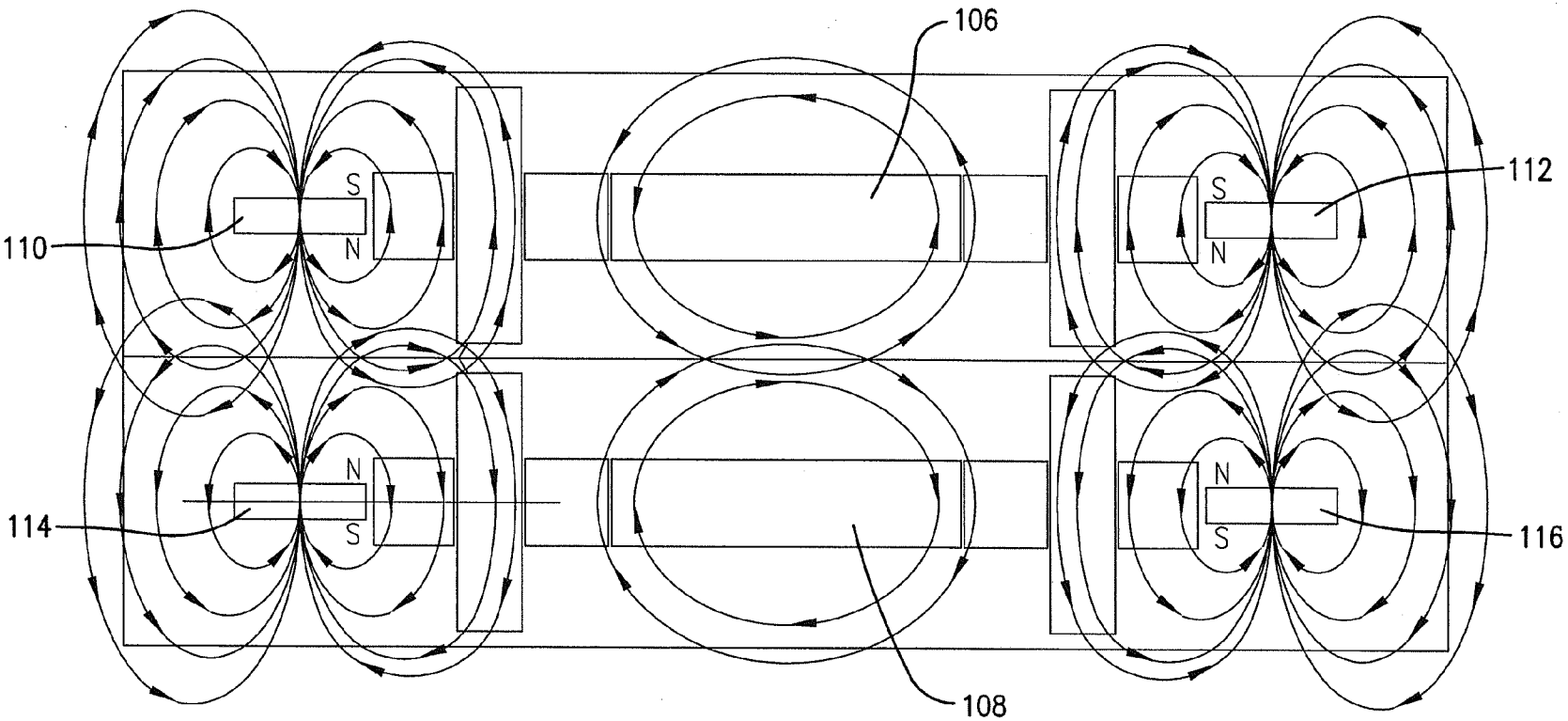
FIG. 6 is a schematic diagram of various elements of the assembly of FIG. 4, demonstrating magnetic flux lines of various magnetized elements of the apparatus.

Turning now to FIGS. 4-6, a second embodiment of the invention is illustrated, wherein an apparatus 100 comprises a first device 102 and a second device 104 in a stacked configuration. Each of the devices 102,104 may be similar or identical to the device 10 in form and function. The devices 102,104 may be physically attached or secured to form the apparatus 10, and may further be electrically connected such that there is electrical interaction, magnetic interaction, or both between the devices 102,104. By way of example, a control element 106 of the first device 102 may be electrically connected in series with a control element 108 of the second device 104, such that both control elements 106,108 are energized as a single unit.

An outer shell 118 may further encase, shield and protect the apparatus 100, may be constructed of aluminum, and may include one or more fins or heat sinks 120 to enhance heat dissipation. While the shell 118 is not essential to the operation of the apparatus 100, it has been omitted from FIG. 4 for illustrative purposes only.

As illustrated in FIG. 6, placing the devices 102,104 in close proximity to each other may enable the magnetic fields of each device to interact. This may benefit operation of the apparatus 100 by, for example, increasing operational efficiency by mitigating losses in the magnetic fields. As illustrated in FIG. 6, the devices 102,104 may be positioned such that magnets 110,112,114,116 in the devices 102,104 are oriented with like poles in close proximity, and the control elements 106,108 may be interconnected such that electric current in the first control element 106 flows in the same direction as electric current in the second control element 108. These configurations may vary from one implementation to another without departing from the scope of the invention. For example, the devices 102,104 may be positioned such that the magnets 110,112,114,116 are oriented with opposite poles in close proximity, and the control elements 106,108 may be interconnected such that electric current in the first 106 and second 108 control elements flows in opposite directions.

While the illustrated apparatus 100 comprises two devices 102,104 in a stacked relationship, the present teachings contemplate any number of devices combined in the same manner, all of which may be physically and electrically interconnected in the same manner as the devices.

It will be appreciated that the magnetic flux lines illustrated in FIG. 6 are intended to show the proximity and possible overlap of various fields, and does not necessarily accurately depict the interference or interaction of the various magnetic fields.

Figure 8:
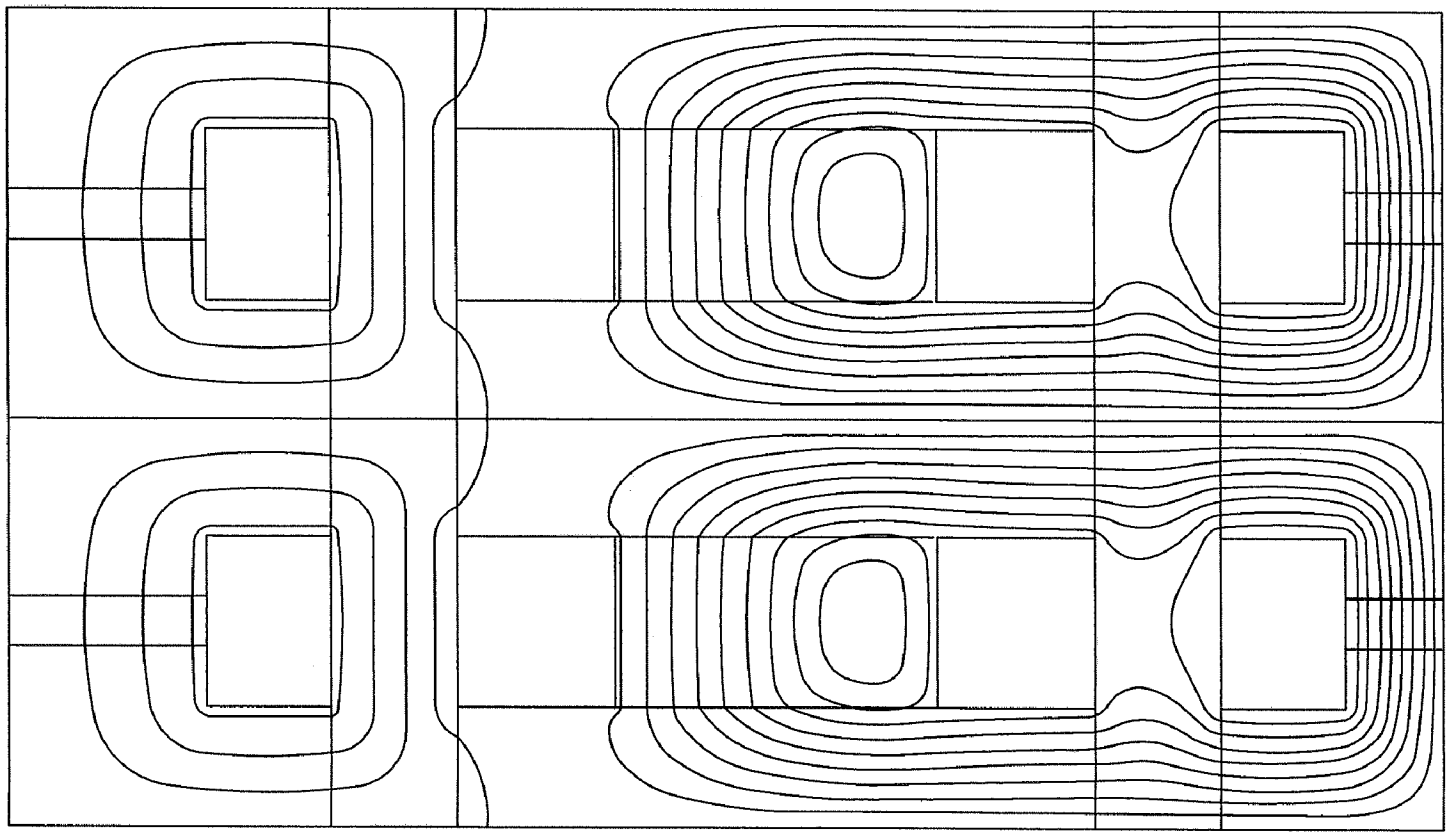
FIG. 8 is a schematic diagram of various elements of the assembly of FIG. 4, illustrating the interaction of magnetic flux fields when electric current is applied in a first direction to control elements of the assembly.
Figure 9:
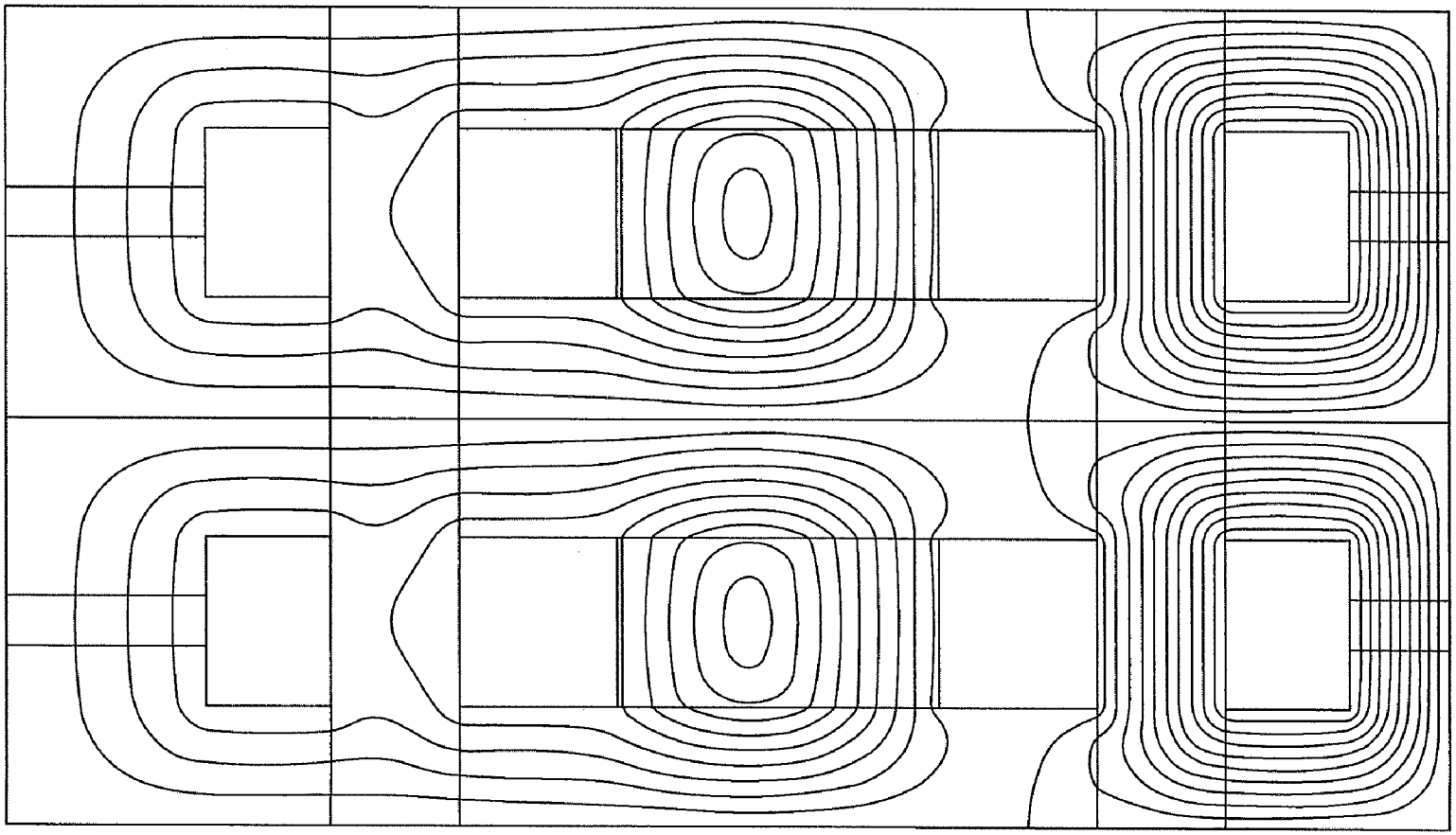
FIG. 9 is a schematic diagram of various elements of the assembly of FIG. 4, illustrating the interaction of magnetic flux fields when electric current is applied in a second direction to control elements of the assembly.

Turning now to FIGS. 8 and 9, an exemplary operation of the apparatus 100 is illustrated in which interaction of the magnetic fields is shown in more detail. FIG. 8 illustrates the apparatus 100 with electric current applied to the control element 106 in a first direction, and FIG. 9 illustrates the apparatus 100 with electric current applied to the control element 106 in a second direction. In both Figures, electric current is applied to the control element 108 in a direction that is opposite the direction of the current applied to the control element 106. The magnetic elements 110,114 and 112,116 are positioned with like magnetic polls proximate, similar to the configuration illustrated in FIG. 6. As can be seen, the magnetic flux profile of the various elements differs substantially between the two scenarios, wherein magnetic flux from the control elements 106,108 shifts towards the outer magnetic elements 112,116 in FIG. 8 and towards the inner magnetic elements 110,114 in FIG. 9. It will be appreciated that if alternating currents are introduced into the control elements 106,108, the magnetic flux lines may shift between these two scenarios such that the total amount of magnetic flux passing through the various conductive elements is always changing.

Although the invention has been described with reference to the exemplary embodiments illustrated in the attached drawings, it is noted that equivalents may be employed and substitutions made herein without departing from the scope of the invention as recited in the claims. For example, while in some cases particular dimensions have been provided, it will be understood that such are exemplary in nature and may be modified with equally favorable results. Furthermore, while various elements have been described as concentric, coplanar, or both, it will be understood that such elements need not be perfectly concentric or coplanar and that variations may be made with equally favorable results.

Having thus described various embodiments of the invention, what is claimed as new and desired to be protected by Letters Patent includes the following:

1. A flux transfer device comprising:

a first conductive element presenting a loop configuration for generating magnetic flux when energized by an electric current;

a second conductive element presenting a loop configuration and being concentric with the first conductive element, the second conductive element for generating an electric voltage in response to changes in the magnetic flux; and a first magnetic element concentric with the first conductive element, wherein the magnetic flux generated by the first conductive element displaces at least a portion of the magnetic flux from the first magnetic element, thereby inducing an electric voltage in the second conductive element.

2. The flux transfer device as set forth in claim 1, wherein the first conductive element, the second conductive element, and the first magnetic element each present a ring shape and are substantially coplanar.

3. The flux transfer device as set forth in claim 1, further comprising a permeance element concentric with the first conductive element, wherein the permeance element channels at least a portion of the magnetic flux from the first magnetic element and at least a portion of the magnetic flux from the first conductive element, and wherein the magnetic flux from the first conductive element displaces at least a portion of the magnetic flux from the first magnetic element in the permeance element, thereby changing an amount of magnetic flux passing through the second conductive element.

4. The flux transfer device as set forth in claim 1, further comprising:

a third conductive element presenting a loop configuration and being concentric with the first conductive element, the third conductive element for generating an electric voltage in response to changes in magnetic flux; and a second magnetic element concentric with the third conductive element, wherein the magnetic flux from the first conductive element displaces at least a portion of the magnetic flux from the second magnetic element, thereby changing an amount of magnetic flux passing through the loop formed by the third conductive element.

5. The flux transfer device as set forth in claim 4, wherein the first conducting element is positioned radially inward of the second conducting element, and the third conducting element is positioned radially outward of the second conducting element.

6. The flux transfer device as set forth in claim 1, the first conductive element including a coil of copper clad steel ribbon.

7. The flux transfer device as set forth in claim 1, the second conductive element including a copper coil.

8. A method of using the flux transfer device of claim 1, comprising:

connecting the first conductive element to a load; and applying an alternating current to the second conductive element.

9. A method of using the flux transfer device as set forth in claim 1, comprising:

electrically connecting the second conducting element of the device in series with the second conducting element of a second flux transfer device identical to the first flux transfer device; and applying an alternating current to the second conducting element of the first device.

10. A flux transfer device comprising:

a first metal coil for generating magnetic flux when energized by an electric current;

a second metal coil positioned radially inward of and concentric with the first metal coil, the second metal coil for generating an electric voltage in response to changes in magnetic flux;

a first magnetic element positioned radially inward of and concentric with the second metal coil, a third metal coil positioned radially outward of and concentric with the first metal coil, the third metal coil for generating an electric voltage in response to changes in magnetic flux; and a second magnetic element positioned radially outward of and concentric with the third metal coil, wherein the magnetic flux generated by the first metal coil causes magnetic flux generated by the first and second magnetic elements to shift, thereby altering an amount of magnetic flux passing through the second and third metal coils.

11. The flux transfer device as set forth in claim 10, further comprising:

a first permeance element for channeling magnetic flux, the first permeance element positioned between the second metal coil and the first magnetic element and concentric with the second metal coil; and a second permeance element for channeling magnetic flux, the second permeance element positioned between the third metal coil and the second magnetic element and concentric with the third metal coil.

12. The flux transfer device as set forth in claim 11, each of the first and second permeance elements include 30% copper coated steel ribbon.

13. The flux transfer device as set forth in claim 10, further comprising a plurality of transformer plates substantially encasing the device.

14. The flux transfer device as set forth in claim 10, the first metal coil including 40% copper coated steel ribbon, the second metal coil including copper ribbon, and the third metal coil including copper ribbon.

15. The flux transfer device as set forth in claim 10, the first metal coil, the second metal coil, the first magnetic element, the third metal coil, and the second magnetic element all being substantially coplanar.

16. A method of using the flux transfer device as set forth in claim 10, comprising:

connecting each of the second and third conductive elements to a load; and applying an alternating current to the first conductive element.

17. A method of using the flux transfer device as set forth in claim 10, comprising:

electrically connecting the first conducting element of the device in series with the first conducting element of a second, identical device; and applying an alternating current to the combined first conductive elements.

18. A flux transfer device comprising:

a first magnetic element presenting a loop configuration;

a first conductive element presenting a loop configuration and positioned concentrically outwards of the first magnetic element;

a first permeance element presenting a loop configuration and positioned concentrically outwards of the first conductive element, the first permeance element for channeling magnetic flux from the first magnetic element;

a second conductive element presenting a loop configuration and positioned concentrically outwards of the first permeance element;

a third conductive element presenting a loop configuration and positioned concentrically outwards of the second conductive element;

a fourth conductive element presenting a loop configuration and positioned concentrically outwards of the third conductive element;

a second permeance element presenting a loop configuration and positioned concentrically outwards of the fourth conductive element;

a fifth conductive element presenting a loop configuration and positioned concentrically outwards of the second permeance element; and a second magnetic element for generating a magnetic field and presenting a loop configuration, wherein the second magnetic element is placed concentrically outwards of the fifth conductive element, and wherein magnetic flux generated by the second magnetic element is channeled by the second permeance element.

19. A method of using the flux transfer device as set forth in claim 18, comprising:

connecting at least one of the first, second, fourth or fifth conductive elements to a load; and applying an alternating current to the third conductive element.

20. A method of using the flux transfer device as set forth in claim 18, comprising:

electrically connecting the third conductive element of the device in series with the third conducting element of a second, identical device; and applying an alternating current to the interconnected third conductive elements.

* * * * *